US007539438B2

(12) United States Patent
van Leipsig et al.

(10) Patent No.: US 7,539,438 B2
(45) Date of Patent: May 26, 2009

(54) CLEANING BLADE SEAL

(75) Inventors: Gerardus Maria Petrus van Leipsig, Tegelen (NL); Petrus Johannes Maria Bloemen, Cuijk (NL); Petrus Wilhelmus Antonius Hendriks, Grubbenvorst (NL); Ludovicus Antonius Maria Nooyens, Eindhoven (NL); Antonius Franciscus Jozef Wijnen, Melderslo (NL); Bartholomeus Wilhelmus Christiaan Hovens, Venlo (NL); Leendert Schoordijk, Kevelaer (DE); Lambertus Henrikus Gerardus Maria van Stiphout, Mierlo (NL)

(73) Assignee: Xerox Corporation, Norwalk, CT (US)

( * ) Notice: Subject to any disclaimer, the term of this patent is extended or adjusted under 35 U.S.C. 154(b) by 264 days.

(21) Appl. No.: 11/171,534

(22) Filed: Jun. 30, 2005

(65) Prior Publication Data

US 2007/0003318 A1 Jan. 4, 2007

(51) Int. Cl.
*G03G 15/00* (2006.01)

(52) U.S. Cl. ..... 399/102

(58) Field of Classification Search ..... 399/102
See application file for complete search history.

(56) References Cited

U.S. PATENT DOCUMENTS

| | | | | |
|---|---|---|---|---|
| 5,389,732 | A | 2/1995 | Sekino | |
| 5,442,422 | A | 8/1995 | Owens, Jr. et al. | |
| 5,475,467 | A | 12/1995 | Watanabe et al. | |
| 5,701,558 | A | 12/1997 | Kojima | |
| 6,553,195 | B2 * | 4/2003 | Korfhage et al. | 399/102 |
| 6,744,999 | B2 * | 6/2004 | Bloemen et al. | 399/102 |
| 6,980,752 | B2 * | 12/2005 | Kamimura | 399/103 |
| 2003/0235427 | A1 * | 12/2003 | Bloemen et al. | 399/102 |
| 2005/0095031 | A1 * | 5/2005 | Hashimoto et al. | 399/103 |

* cited by examiner

*Primary Examiner*—David M Gray
*Assistant Examiner*—Erika Villaluna
(74) *Attorney, Agent, or Firm*—Maginot, Moore & Beck LLP

(57) ABSTRACT

An apparatus for a printing device includes a roller, a sealing member defining a generally C-shaped indentation, and a cleaning blade positioned against the roller. The cleaning blade includes an end portion positioned in the generally C-shaped indentation.

1 Claim, 3 Drawing Sheets

CLEANING BLADE SEAL

TECHNICAL FIELD

The presently disclosed embodiments are directed to blade seals as could be used in a number of devices such as, for example, xerographic printing devices.

BACKGROUND

The basic principles of electrostatographic printing with dry marking material (hereinafter generally referred to as "xerography," "xerographic printing," and/or the like) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in imagewise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed by any number of known means, such as including a cleaning blade, brush, and/or vacuum. In a typical embodiment, the removed toner is then accumulated in a hopper, and then the accumulated waste toner is directed, typically by means of an auger, into a waste container.

It is a common design challenge to provide a functional housing around the photoreceptor, which allows operation of the xerographic apparatus while preventing leakage of stray toner particles to unwanted areas within the apparatus. More particularly, some designs employing cleaning blades to remove residual toner particles from their photoreceptors have included seals at one or more lateral ends of the cleaning blades to help prevent leakage of the residual toner to unwanted areas. For example, U.S. Pat. No. 6,744,999 to Bloemen et al., issued Jun. 1, 2004 ("Bloemen") discloses a xerographic printing apparatus using a blade to clean the surface of a rotating photoreceptor. At an end of the blade is disposed a flexible sealing member. The sealing member includes a bulk portion, one part of which contacts the surface of the photoreceptor and another part of which is attached to a stationary surface. Extending from the bulk portion is a tab which defines a diagonal edge. A portion of the diagonal edge contacts a surface of the blade.

Even though providing seals around cleaning blades is generally known, aligning and securing such seals to ensure their effectiveness has been challenging.

SUMMARY

According to aspects illustrated herein, there is provided an apparatus for a printing device including a roller, a sealing member defining a generally C-shaped indentation, and a cleaning blade positioned against the roller. The cleaning blade includes an end portion positioned in the generally C-shaped indentation. The apparatus could be used in a number of devices such as, for example, a xerographic printing device.

According to aspects illustrated herein, there is provided an apparatus including a xerographic photoreceptor, a sealing member defining a generally C-shaped indentation, and a blade positioned against the photoreceptor. The blade includes an end portion positioned in the generally C-shaped indentation.

According to aspects illustrated herein, there is provided a method including inserting a cleaning blade of a xerographic cleaning blade assembly into a generally C-shaped indentation defined by a seal member, and affixing a first portion of the seal member to a support member of the xerographic cleaning blade assembly outside of the generally C-shaped indentation, thereby forming a sub-assembly. The sub-assembly could be used in a number of devices such as, for example, a xerographic printing device.

DETAILED DESCRIPTION

Figure 1:
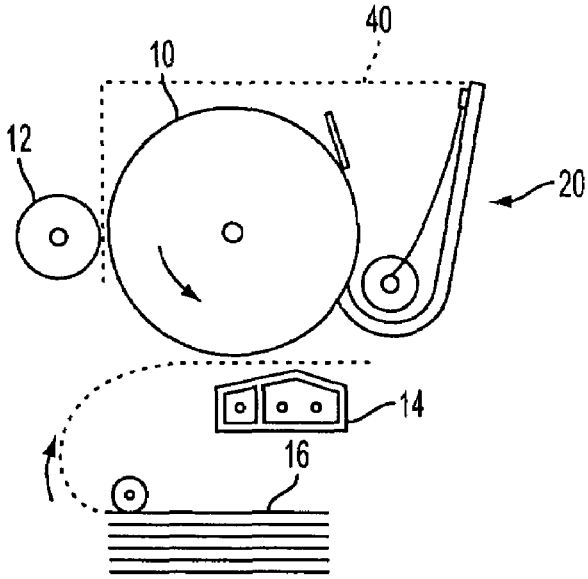
FIG. 1 is a simplified elevational view showing relevant elements of an electrostatographic or xerographic printing apparatus, many of which are disposed within a module.

FIG. 1 is a simplified elevational view showing relevant elements of an electrostatographic or xerographic printing apparatus, many of which are disposed within a module housing generally shown as 40. As is well known, an electrostatic latent image is created, by means not shown, on a surface of a charge receptor or photoreceptor 10. The latent image is developed by applying thereto a supply of toner particles, such as with developer roll 12, which may be of any of various designs such as a magnetic brush roll or donor roll, as is familiar in the art. The toner particles adhere to the appropriately charged areas of the latent image. The surface of photoreceptor 10 then moves, as shown by the arrow, to a transfer zone created by a transfer-detack assembly generally indicated as 14. Simultaneously, a print sheet on which an desired image is to be printed is drawn from supply stack 16 and conveyed to the transfer zone 14 as well.

At the transfer zone 14, the print sheet is brought into contact or at least proximity with a surface of photoreceptor 10, which at this point is carrying toner particles thereon. A corotron or other charge source at transfer zone 14 causes the toner on photoreceptor 10 to be electrically transferred to the print sheet. The print sheet is then sent to subsequent stations, as is familiar in the art, such as a fuser and finishing devices (not shown).

Figure 2:
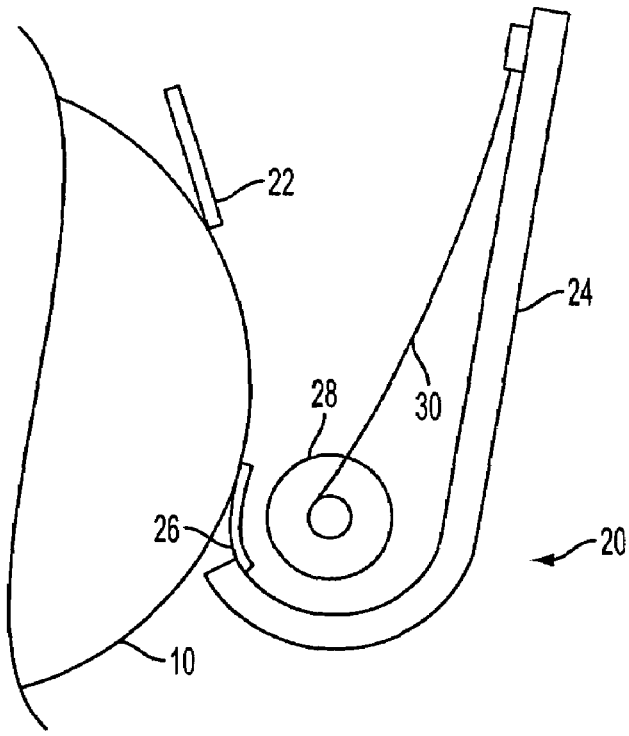
FIG. 2 is an elevational view of a cleaning station formed by part of the module of FIG. 1.

Following transfer of most of the toner particles to the print sheet in the transfer zone, any residual toner particles remaining on the surface of photoreceptor 10 are removed at a cleaning station, which is generally indicated as 20. FIG. 2 is an elevational view of a cleaning station 20. As can be seen in the figure, a cleaning blade assembly 22 includes a cleaning blade 23 which is urged against the surface of photoreceptor 10 and scrapes the residual toner off the surface. The toner which is thus removed falls downward into the housing 24 forming a hopper for accumulating the toner. A flexible flap seal 26, extending the length of the photoreceptor 10, prevents loose toner from escaping the hopper.

At the bottom of the hopper is an auger 28, here shown end-on. The auger extends substantially the length of the photoreceptor 10. The auger 28 is rotated and thus conveys toner particles at the bottom of the hopper to some sort of waste container (not shown). An agitator 30, made of a thin, flexible material, can interact with the auger to clean the flights of the auger.

Figure 3:
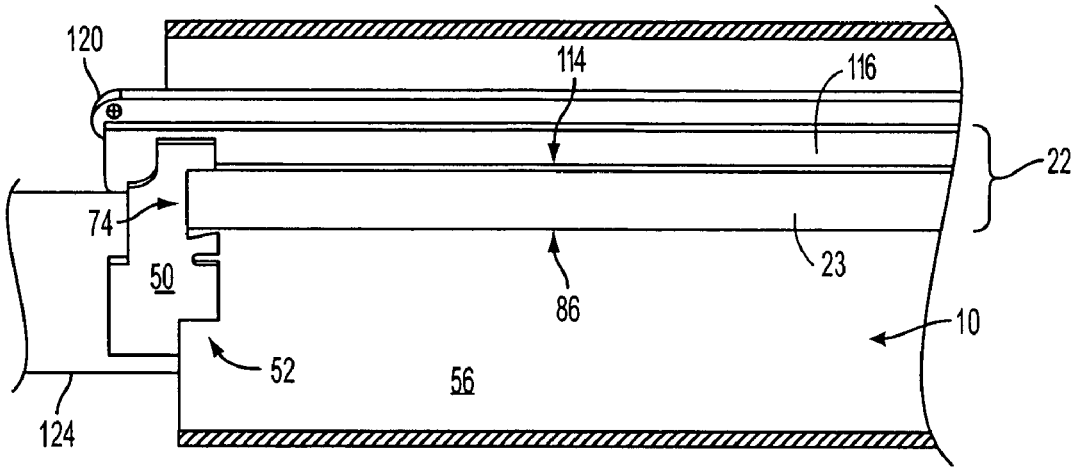
FIG. 3 is an elevational view of the end of a cleaning blade assembly and a sealing member as they are installed against a surface of a photoreceptor in a module.
Figure 4:
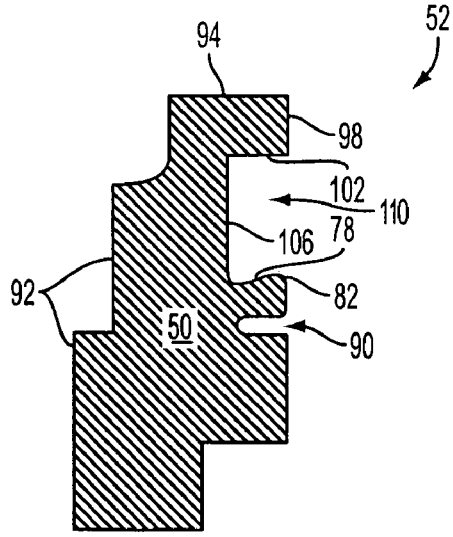
FIG. 4 is a view of a first side of a sealing member used in a module, in isolation.
Figure 5:
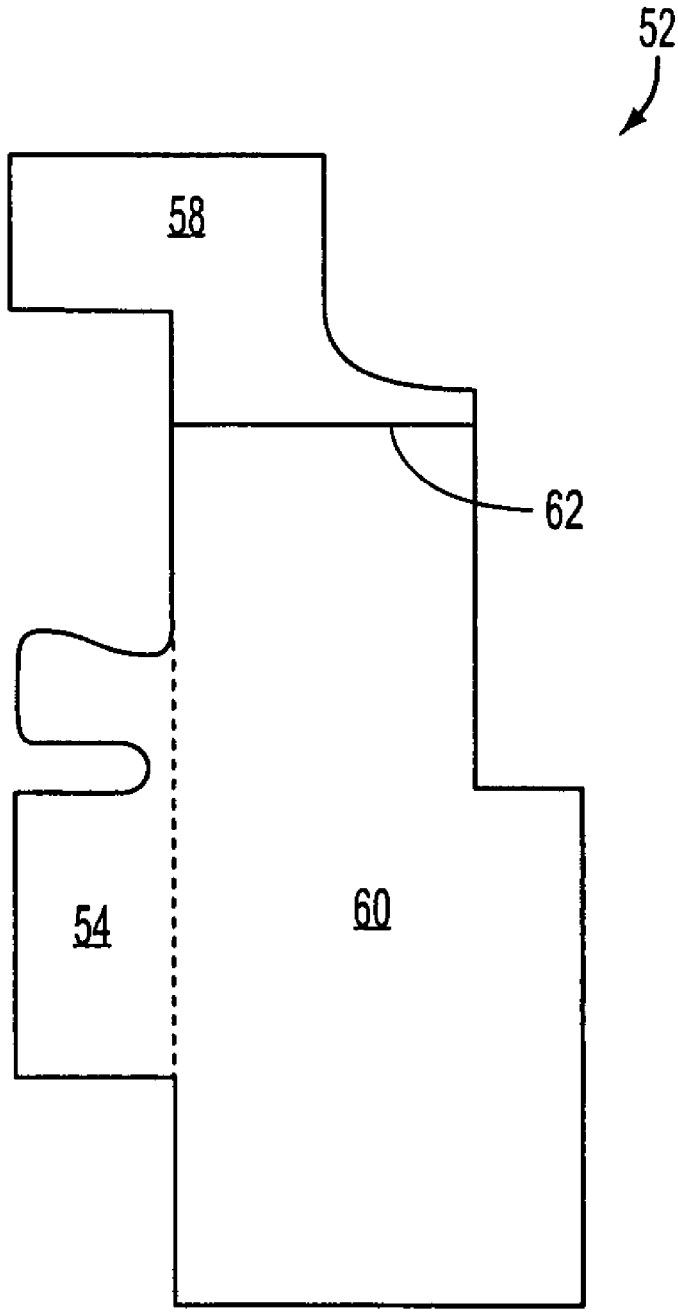
FIG. 5 is a view of a second side of the sealing member.

FIG. 3 is an elevational view of the end of cleaning blade assembly 22 as it is installed against a surface of photoreceptor 10, while FIG. 4 is a view of a first side 50 of a sealing member 52 used therein, in isolation, and FIG. 5 is a view of a second side of the sealing member 52. The sealing member 52 comprises a resilient material forming the bulk thereof. As discemable in FIG. 5, the sealing member 52 includes a surface area 54 on the second side thereof. Comparing FIG. 3 and FIG. 5, it can be seen that the surface area 54 is intended to abut, and slide against, a rotating surface 56 of the photoreceptor 10. Additionally, the sealing member 52 includes a surface area 58 and a surface area 60 on the second side thereof. In the illustrated embodiment, surface area 54, surface area 58 and surface area 60 are provided by a layer of split-line backed double-sided adhesive tape, with the inner side or front adhesive face of the tape laid on and affixed to the resilient bulk of the sealing member 52 and the opposing outer side or back adhesive face of the tape forming surface area 54, surface area 58, and surface area 60. The outer side backing of the tape is split into two individually removably pieces along a line 62 extending between the surface area 58 and the surface area 60 such that the surface area 58 is exposed by removing one piece of the backing while the surface area 54 and the surface area 60 are jointly exposed by removing the other piece of the backing. It is noted that although the surface area 54 is an adhesive surface, the resiliency of the bulk of the sealing member provides freedom for the rotating the surface 56 of the photoreceptor 10 to slide against the surface area 54; moreover, the portion of the rotating surface 56 that engages with the surface area 54 is made of a suitable foam or other suitably low friction material. Meanwhile, in operation the adhesive properties of the surface area 54 enhance the effectiveness of the sealing member 52 by preventing undesirable leakages of toner particles.

Comparing FIG. 3 and FIG. 4, it can be seen that the overall profile of the sealing member 52 includes a number of "straight" edges which are intended to be largely perpendicular to the direction of rotation of the photoreceptor 10, and also to an end edge 74 of the cleaning blade 23. However, the profile also defines a slanted edge 78 that is oriented diagonally to the direction of rotation of the roller 10. A rounded tip portion 82 extends from the slanted edge 78 to contact a long "cleaning edge" 86 of the cleaning blade 23. When the cleaning blade assembly 22 is installed in the module, the tip portion 82 extending from slanted edge 78 is partially flattened, and put in contact with the cleaning blade 23. A first indentation 90 in the profile, opposite the slanted edge 78 relative to the cleaning blade 23, functions as a "tell tale" during installation, ensuring minimal force is exerted to the working edge of the cleaning blade 23. In the illustrated embodiment, the portion of the sealing member 52 that defines the slanted edge 78 and indentation 90 extends as a tab from a bulk portion 92 of the sealing member 52. If, during installation, the tip portion 82 is barely touching the cleaning blade 23, rotation of the photoreceptor 10, in combination with the (sufficiently low) seal friction between the photoreceptor 10 and the surface area 54 of the sealing member 52, moves the portion of the seal between edge 78 and indentation 90 in the direction of the cleaning blade 23, allowing the tip portion 82 to make contact with and seal the blade area, thus assuring the sealing function.

A lead edge 94 of the profile is positioned upstream of the slanted edge 78 relative to the direction of movement of photoreceptor 10 and extends generally perpendicularly to the direction of movement of photoreceptor 10. A side edge portion 98 of the profile extends generally perpendicularly from the lead edge 94 towards the sloped edge 78 while an edge portion 102 of the profile extends generally perpendicularly from side edge portion 98 to a side edge portion 106 such that side edge portion 98 and edge portion 102 extend as a tab from bulk portion 92. A side edge portion 106 of the profile extends between edge portion 102 and slanted edge 78 such that slanted edge 78, edge portion 102, and edge portion 106 form a generally C-shaped second indentation 110.

As discernable in FIG. 3, cleaning blade 23 also has a long "upstream edge" 114 opposite the cleaning edge 86. When the cleaning blade 23 is inserted into the indentation 110 formed by sealing member 52, the edge portion 102 of the sealing member 52 contacts and aligns with the upstream edge 114 of the cleaning blade 23, while the edge portion 106 of the sealing member 52 contacts and aligns with the end edge 74 of the cleaning blade 23 and the slanted edge 78 contacts and aligns with the cleaning edge 86 of the cleaning blade 23. In the illustrated embodiment, the sealing member 52 is first aligned on the cleaning blade 23 in the foregoing manner and then the sealing member 52 is affixed to a support member 116 of the cleaning blade assembly 22 via the adhesive surface area 58. Next, the cleaning blade assembly 22 and the sealing member 52 (as a sub-assembly) are installed and attached to a first stationary part 120 and a second stationary part 124, respectively, which includes affixing the bulk portion of the sealing member 52 to the stationary part 124 via the adhesive surface area 60. In operation, the surface area 54 of the sealing member 52 contacts and slides against an edge of the rotating photoreceptor 10, while the bulk portion 92 of the sealing member 52 remains attached to the stationary part 124 via the adhesive surface area 60 and the adhesive surface area 58 of the sealing member 52 remains attached to the end of the cleaning blade assembly 22.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The words "printer," "printing device," and the like as used herein encompass any apparatus, such as a digital copier, bookmaking machine, facsimile machine, multi-function machine, etc. which forms a print outputting function for any purpose.

What is claimed is:

1. An apparatus for sealing a cleaning blade in a printing device, comprising:

a sealing member body having at least three edges defining a generally C-shaped opening in the body, and an indentation in the body that is separated from and located below the generally C-shaped opening and which is generally parallel to a bottom edge of the generally C-shaped opening, the bottom edge of the generally C-shaped opening slanting into the generally C-shaped opening and terminating into a protrusion extending into the generally C-shaped opening, a lower edge of the generally C-shaped opening and the indentation forming a first tab that extends from the sealing member body, and a top edge of the generally C-shaped opening and a lead edge of the sealing member body forming a second tab that extends from the sealing member body, the first tab having a length that is approximately equal to a length of the second tab, the second tab having a first double-sided adhesive surface positioned on a surface of the second tab located above the generally C-shaped opening to enable the sealing member body to be affixed to a support member, and the sealing member body having a second double-sided adhesive surface positioned on a surface of the sealing member body that does not cover a surface of the first tab to enable the sealing member body and the support member affixed to the sealing body member to be mounted to a printer component surface and to position a portion of the second double-sided adhesive surface into contact with a rotating photoreceptor to enable the portion of the second double-sided adhesive surface to slide against the rotating photoreceptor; and a cleaning blade having an end edge, a top edge, and a bottom edge, the top edge of the cleaning blade contacts and aligns with the top edge of the generally C-shaped opening in the sealing member body, the end edge of the cleaning blade contacts and aligns with an edge of the generally C-shaped opening that joins the top edge and the bottom edges of the generally C-shaped opening, and the bottom edge of the cleaning blade being proximate the bottom edge of the generally C-shaped opening in the sealing member body, the indentation enabling a portion of the sealing member body between the bottom edge of the generally C-shaped opening and the indentation to move in a direction that urges the protrusion on the bottom edge of the generally C-shaped opening to contact the bottom edge of the cleaning blade.

* * * * *